US010321764B2

(12) United States Patent
Caluwaert

(10) Patent No.: US 10,321,764 B2
(45) Date of Patent: Jun. 18, 2019

(54) PORTABLE CUSHION SYSTEM

(71) Applicant: Laurie Caluwaert, Fort Lauderdale, FL (US)

(72) Inventor: Laurie Caluwaert, Fort Lauderdale, FL (US)

(73) Assignee: Laurie Calowaert, Fort Lauderdale, FL (US)

( * ) Notice: Subject to any disclaimer, the term of this patent is extended or adjusted under 35 U.S.C. 154(b) by 218 days.

(21) Appl. No.: 15/586,237

(22) Filed: May 3, 2017

(65) Prior Publication Data

US 2017/0332793 A1 Nov. 23, 2017

Related U.S. Application Data

(60) Provisional application No. 62/331,348, filed on May 3, 2016.

(51) Int. Cl.
*A47C 7/02* (2006.01)
*A45F 3/14* (2006.01)

(52) U.S. Cl.
CPC ..... *A47C 7/021* (2013.01); *A45F 3/14* (2013.01); *A45F 2003/142* (2013.01)

(58) Field of Classification Search
None
See application file for complete search history.

(56) References Cited

U.S. PATENT DOCUMENTS 2,593,319 A 4/1952 Levitin
3,469,882 A 9/1969 Larsen
4,190,918 A 3/1980 Harvell
4,553,785 A 11/1985 Duke
4,654,907 A * 4/1987 Haugaard ..... A45C 3/10 297/17
4,934,540 A 6/1990 Novak
4,987,625 A 1/1991 Edelson
5,066,001 A * 11/1991 Wilkinson ..... A63B 6/00 482/52
5,190,350 A * 3/1993 Hwang ..... A47C 1/143 297/226
5,265,292 A 11/1993 Green
5,275,463 A 1/1994 Rocha
5,301,998 A 4/1994 Davis
5,404,600 A * 4/1995 DeMars ..... A45F 4/02 5/413 R (Continued)

FOREIGN PATENT DOCUMENTS

WO 2010093303 A1 8/2010

*Primary Examiner* — David E Allred

(57) ABSTRACT

A portable cushion system includes a superior cushion section configured for placement under the user's head and upper torso, a midsection cushion section configured for placement under the user's seat and lower back, a proximal inferior cushion section configured for placement under the user's upper legs, a distal inferior cushion section configured for placement under the user's lower legs, two straps coupled on one end to the superior cushion section, two fastener terminals located on the distal inferior cushion section, and configured for fastening to the straps, and wherein when the superior, midsection, proximal inferior, and distal inferior cushion sections are folded, the straps are configured for use as shoulder straps for securing and transporting the system.

7 Claims, 16 Drawing Sheets

(56) References Cited

U.S. PATENT DOCUMENTS 5,540,364 A * 7/1996 Krieger ..... A45F 3/08 224/153
5,584,422 A * 12/1996 Bond-Madsen ..... A45F 4/02 190/903
5,584,456 A 12/1996 Stephens
5,632,050 A * 5/1997 Zajas ..... A47C 20/026 5/632
5,692,257 A * 12/1997 Albertieri ..... A41B 13/06 5/494
5,950,260 A * 9/1999 Dees ..... B25H 5/00 5/417
5,957,528 A * 9/1999 Campbell ..... B60N 2/6036 297/218.4
5,960,520 A 10/1999 Conway
6,244,481 B1 6/2001 Brougher
6,270,155 B1 8/2001 Rashid
6,490,768 B1 12/2002 Goodall
6,616,225 B2 9/2003 Graff
6,626,491 B1 9/2003 Blome
6,655,737 B2 12/2003 Hyduk
6,889,882 B1 * 5/2005 Leep ..... A45F 3/08 224/160
7,020,918 B1 4/2006 Tinsley
7,661,163 B1 2/2010 Gallaher
7,905,039 B2 3/2011 Karovic
8,020,931 B2 * 9/2011 Frady ..... A01M 31/02 297/219.1
8,578,526 B1 * 11/2013 Rosso ..... A47C 1/146 5/417
8,899,677 B2 * 12/2014 Hurlburt ..... A47C 13/00 297/217.1
9,332,858 B1 5/2016 Chiang
2003/0000986 A1 * 1/2003 Smith ..... A01K 97/10 224/637
2003/0094555 A1 5/2003 Prizzi
2004/0045091 A1 * 3/2004 Ogle ..... A47C 27/001 5/722
2005/0046266 A1 * 3/2005 Schiebl ..... A47C 1/16 297/452.41
2006/0010598 A1 1/2006 Rusinak-Connors
2006/0117480 A1 6/2006 Younce
2006/0282949 A1 * 12/2006 Karen ..... A47C 1/146 5/419
2007/0122066 A1 * 5/2007 Landay ..... A45C 11/26 383/16
2007/0210628 A1 9/2007 Arnold
2007/0220717 A1 9/2007 Brinson
2008/0178391 A1 * 7/2008 Andrade ..... A47C 1/146 5/705
2008/0281701 A1 11/2008 Scheiner
2009/0322129 A1 12/2009 Rodill
2010/0001565 A1 1/2010 Gray
2012/0037675 A1 * 2/2012 Shepherd ..... A45C 3/00 224/259
2012/0242126 A1 9/2012 Burns
2014/0070575 A1 * 3/2014 von Saher ..... A47C 7/62 297/188.2
2014/0361055 A1 * 12/2014 Myers ..... A62B 35/0018 224/160
2016/0367021 A1 * 12/2016 Moreau ..... A45F 3/00

* cited by examiner

PORTABLE CUSHION SYSTEM

CROSS-REFERENCE TO RELATED APPLICATIONS

This patent applications claims priority to provisional patent application 62/331,348 filed May 3, 2016 and titled Portable Chaise Lounge Chair. The subject matter of patent application 62/331,348 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of furniture devices and, more specifically, relates to portable furniture devices for use in a variety of environments.

BACKGROUND

Furniture is defined as movable equipment, such as tables and chairs, used to make a space suitable for living. Various different types of well-known furniture are found in the prior art. One area that lacks a significant amount of research and development, however, is the area of portable furniture. It is common for individuals to congregate in areas that don't include conventional furniture. Said areas may include public parks, the beaches, or even the backyard of a home. In these cases, individuals usually bring portable furniture with them, in order to make the space more livable by allowing people to sit, lie down or repose comfortably. Conventional portable furniture include what is known as beach chairs, beach chaise or portable benches. Conventional portable furniture, however, has certain drawbacks.

First, it is well-known that conventional portable furniture can be uncomfortable. This is because many of the conventional portable furniture devices are stripped down to lower its weight. Using more metal or plastic than soft material, said conventional portable furniture devices can dig into the skin and cause pain after prolonged use. Another reason conventional portable furniture can be uncomfortable is because it is often made of inexpensive materials, in order to lower manufacturing costs. This leads to the use of materials that are not as comfortable as more expensive materials.

Secondly, it is well-known that conventional portable furniture can be unwieldy. That is, conventional portable furniture devices can be cumbersome and difficult to carry and set up where needed. Because conventional portable furniture devices usually involve some assembly when setting up the device at its intended location, conventional portable furniture devices are not designed to be easy to carry, thereby affecting their portability. This can be annoying and time consuming to consumers. Conventional folding lounge chairs, in addition, are usually not adjustable to fit in particular person's special physical characteristics, such as long legs. This can also be annoying to consumers and affects the usability of the product. Also, conventional portable furniture devices, such as folding lounge chairs, can have a tendency to collapse, pinch the skin and cause bruises. This can be dangerous for users.

Lastly, conventional portable furniture can be cumbersome and difficult to carry when additional items must be carried. This typically occurs in situations when such conventional portable furniture are used the most, such as going to the beach, a concert, a picnic or other outdoor events, i.e., when other articles are generally carried or desired by the user. This can be time consuming, as it may require that the user make additional trips to gather the items that could not be carried in the first trip.

Therefore, a need exists to overcome the problems with the prior art as discussed above, and particularly for a lightweight, wieldy, portable furniture device that facilitates the ability to carry multiple items at the same time.

SUMMARY

A portable cushion system are provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an article is provided that solves the above-described problems. The portable cushion system comprises: (a) a superior cushion section comprising a cushion apparatus with a cover, wherein the superior cushion section is configured for placement under the user's head and upper torso; (b) a midsection cushion section coupled to the superior cushion section via a hingeable coupling, the midsection cushion section comprising a cushion apparatus with a cover, wherein the midsection cushion section is configured for placement under the user's seat and lower back; (c) a proximal inferior cushion section coupled to the midsection cushion section via a hingeable coupling, the proximal inferior cushion section comprising a cushion apparatus with a cover, wherein the proximal inferior cushion section is configured for placement under the user's upper legs; (d) a distal inferior cushion section coupled to the proximal inferior cushion section via a hingeable coupling, the distal inferior cushion section comprising a cushion apparatus with a cover, wherein the distal inferior cushion section is configured for placement under the user's lower legs; (e) a first strap coupled on one end to the superior cushion section, the first strap including a first fastener on another end; (f) a second strap coupled on one end to the superior cushion section, the second strap including a second fastener on another end; (g) a first fastener terminal located on the distal inferior cushion section, the first fastener terminal configured for fastening to the first fastener of the first strap; (h) a second fastener terminal located on the distal inferior cushion section, the second fastener terminal configured for fastening to the second fastener of the second strap; and (i) wherein when the superior, midsection, proximal inferior, and distal inferior cushion sections are folded along said hingeable couplings, the first fastener is fastened to the first fastener terminal, the second fastener is fastened to the second fastener terminal, and the first and second straps are configured for use as shoulder straps for securing and transporting the system.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
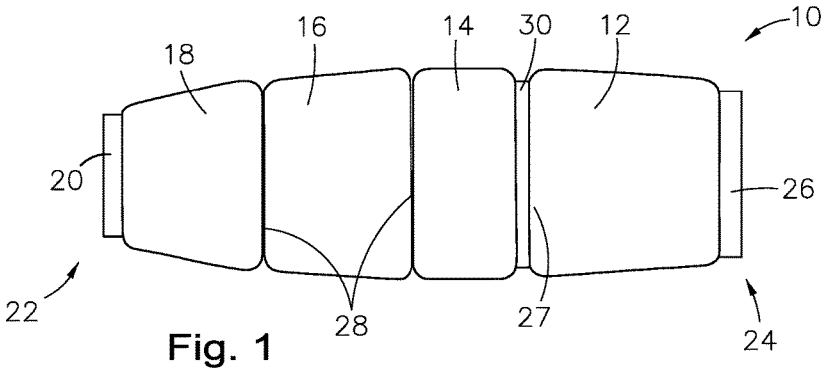
FIG. 1 is a top plan view of a portable cushion system in accordance with one embodiment.

The following detailed description refers to the accompanying drawings. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a portable cushion system that can be easily transported, set-up and used as furniture in settings that do not have furniture. The claimed subject matter presents an inexpensively manufactured device that is comfortable to utilize in a reclined position, easy to transport, and facilitates the transport of additional items, along with the portable furniture device itself. These features allow for greater usability for consumers. The claimed subject matter also presents a device that cannot collapse, pinch the skin or cause bruises, which also adds to the usability of the device.

FIGS. 1-12 show an exemplary embodiment of the claimed portable cushion system 10, resembling a chaise lounge chair, in accordance with the principles of the invention. The system 10 in this embodiment has four sections. The superior section 12 is configured and sized to accommodate the torso and head of a person recumbent upon the system 10. The midsection 14 roughly corresponds to the lower back and the seat of a user. A proximal inferior section 16 may be configured to accommodate the thighs and upper legs of a user and the distal inferior section 18 is configured to accommodate the lower legs including the shins, calves and feet. An inferior fastening strip 20 is located at the distal inferior end 22 of the system 10. In this embodiment, the fastening strip 20 is an elongate ribbon of material having a hook and loop mechanism on one or both sides. Optionally, the inferior fastening strip 20 may lie flat against the distal end 22. Similarly, the distal superior end 24 of the system 10 includes a distal superior fastening strip 26. The superior section 12 also includes a proximal fastening strip 27. The distal superior fastening strip 26 and the proximal fastening strip 27 are also elongate ribbons of material having a hook and loop mechanism on one or both sides and may also optionally lie flat against the distal end 24 or be affixed only along one side.

In this embodiment, system 10 is a unitary structure. The superior section 12, the midsection 14, the proximal inferior section 16 and the distal inferior section 18 are delineated and separated from one another by transverse seams 28 formed by stitching through the material of which the system 10 is constructed. The superior section 12 and midsection 14 are connected by a panel 30 formed by stitching two transverse seams a short distance apart. Preferably, the material used is both waterproof and machine washable. The material used is also preferably resistant to damage and deterioration caused by moisture and humidity. Also, a cooling agent may either be sprayed on to the fabric of the system or a gel comprised of the inner components of the inner fillings may be used. The cooling layer may be constructed from polyvinyl alcohol (PVA).

All of the superior section 12, the midsection 14, the proximal inferior section 16 and the distal inferior section 18 are configured and sized to accommodate the intended portions of a user's body. Each section may also include an internal compartment defined by the material from which the system 10 is constructed and the transverse seams 28 of the system 10. Optionally, some or all of the sections may include piping about their peripheries. The piping may provide structural support to assist the various sections in keeping a proper shape and preventing them from bunching up. The internal compartments of the sections are accessed by slits 32 in the sections that may be closed using a zipper, tongue and groove mechanism, buttons, magnets and/or other sealing mechanisms.

A storage pocket 34 is located on the bottom 36 of the system 10 and is accessible through slit 38 that may be opened and closed using suitable sealing mechanisms as described above. The storage pocket 34 is sized to accommodate a towel, reading materials, sunscreen, cell phones and other materials desirable when visiting a beach, swimming pool, park or other location. Two straps 40 and 42 are also located on the bottom 36 of the system 10 and will be described in more detail below.

An ancillary pillow 44 is also provided in accordance with the principles of the claimed subject matter. The ancillary pillow 44 has a fastening strip 46 configured to be removably attached to the fastening strips 20, 26 and 27. The ancillary pillow 44 may be affixed to the system 10 at various locations to provide a plurality of configurations for the system. In this embodiment, the ancillary pillow 44 has a wedge shape.

Figure 4:
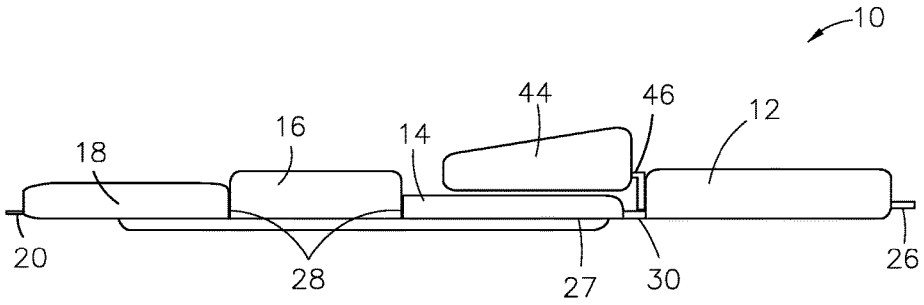
FIG. 4 is another side elevation view of the portable cushion system in accordance with one embodiment.
Figure 5:
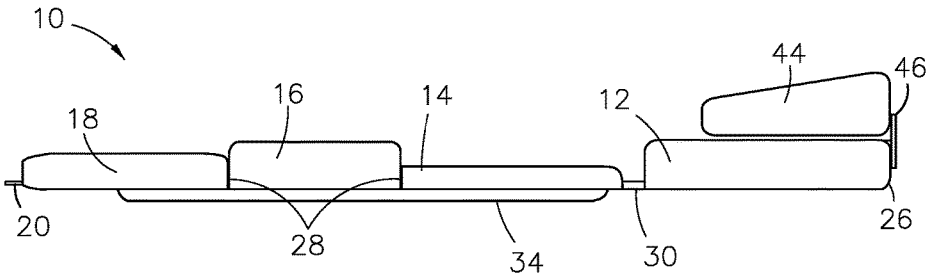
FIG. 5 is another side elevation view of the portable cushion system in accordance with one embodiment.
Figure 6:
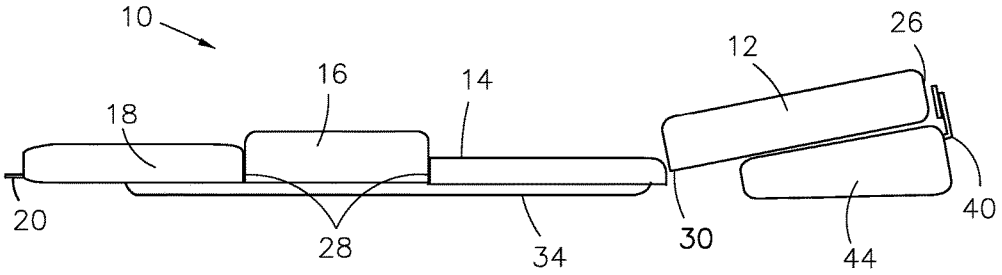
FIG. 6 is another side elevation view of the portable cushion system in accordance with one embodiment.
Figure 7:
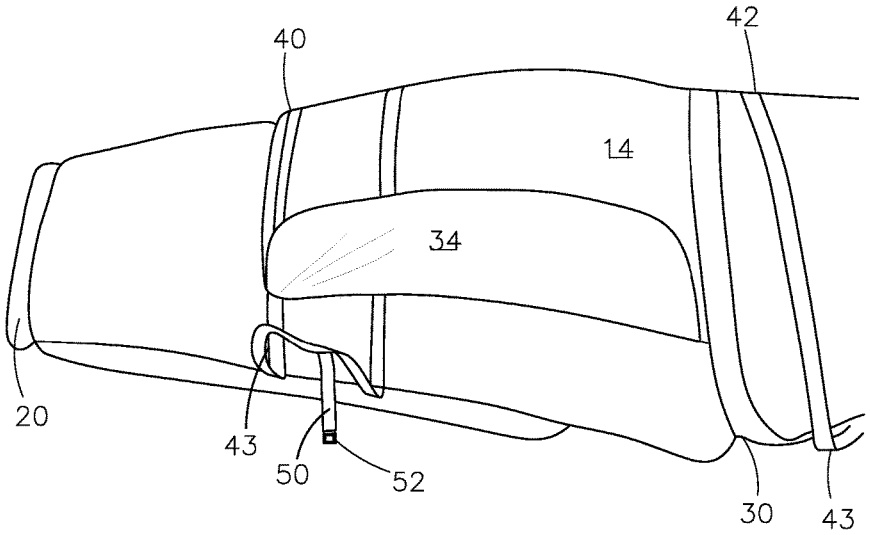
FIG. 7 is a bottom perspective view of the portable cushion system in accordance with one embodiment.
Figure 8:
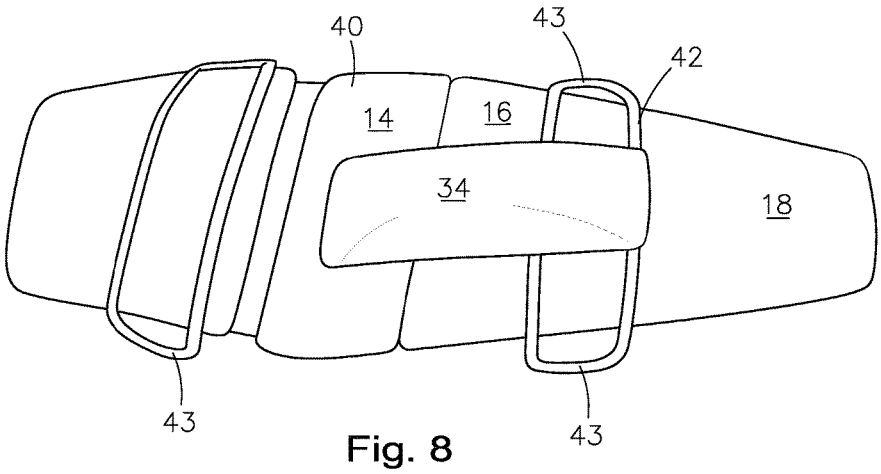
FIG. 8 is another bottom perspective view of the portable cushion system in accordance with one embodiment.
Figure 9:
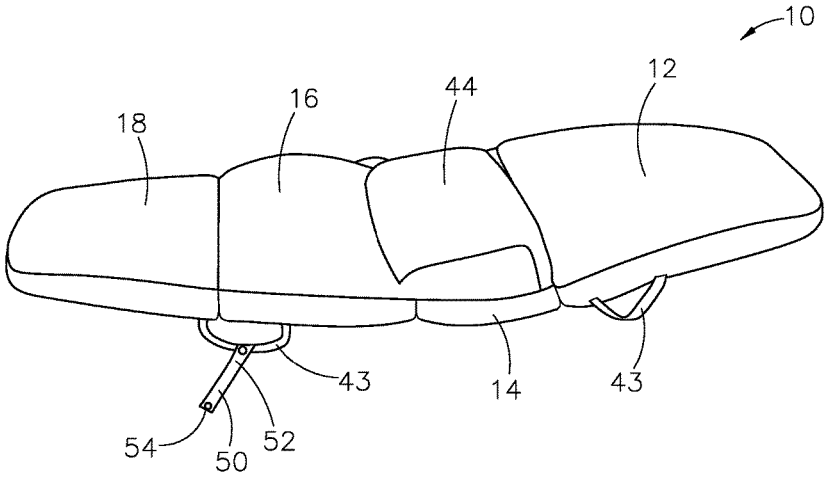
FIG. 9 is another perspective view of the portable cushion system in accordance with one embodiment.
Figure 10:
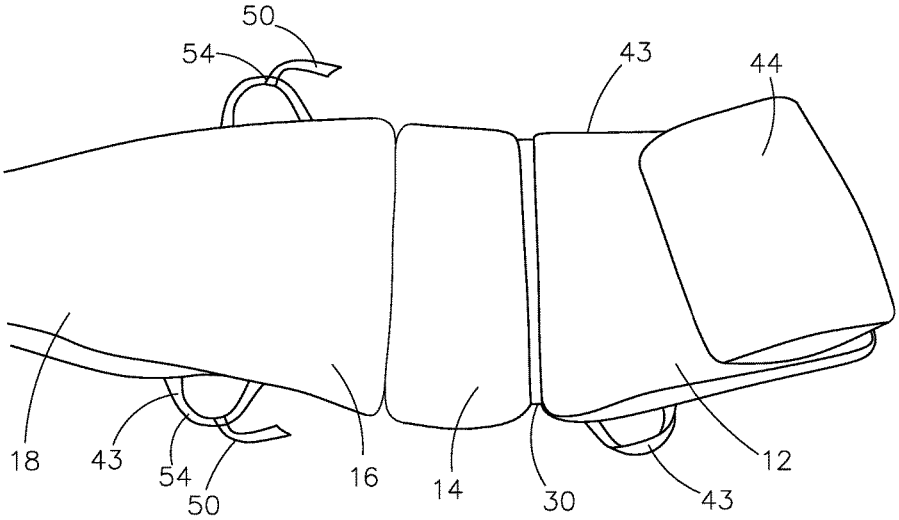
FIG. 10 is another view of the portable cushion system in accordance with one embodiment.

FIG. 4 shows the ancillary pillow 44 attached to the system 10 by affixing the ancillary pillow's fastening strip 46 to the proximal superior fastening strip 27. The ancillary pillow 44 is positioned on top of the midsection 14. This configuration provides additional support to the portion of a user's body positioned above the midsection 14. This may be helpful when a user is lying on his or her back or requires lumbar support. This also provides additional cushioning at the midsection without requiring adjustment of the amount of padding material within the midsection 14. FIG. 5 shows the ancillary pillow 44 in a position for enhancing support to a user's head. The ancillary pillow's fastening strip 46 is affixed to the distal superior fastening strip 26. FIG. 6 shows an alternative method of providing additional support to a user's head. The ancillary pillow 44 is positioned underneath the superior section 12.

The interior compartments of the sections are filled with polystyrene beads, foam or other cushioning material that may be inserted into the compartments directly or may optionally be contained within bags having configurations congruent to their respective sections. The amount of cushioning material placed in each section may be adjusted to accommodate personal preferences of a user. The covers or compartments are removable from the remaining portions of the system, so as to allow the covers to be washed, such as in a washing machine. Also, cording or piping may be woven around the outside of the system to help give it shape and add an aesthetic element.

In one embodiment, the pocket 34 is coextensive with the proximal inferior section 16 and the midsection 14. Optionally, the pocket 34 may extend a greater or lesser distance over the bottom 36. The straps 40 and 42 extend transversely across the system 10. The strap 40 is located across the proximal inferior section 16. The strap 42 is located across the midsection 14. Both straps 40 and 42 form U-shaped loops 43 on either side of the system 10. The strap 40 has a lace 50 extending from each U-shaped loop. The lace 50 includes a snap 52 that releasably engages a snap 54 located on each U-shaped loop.

Figure 2:
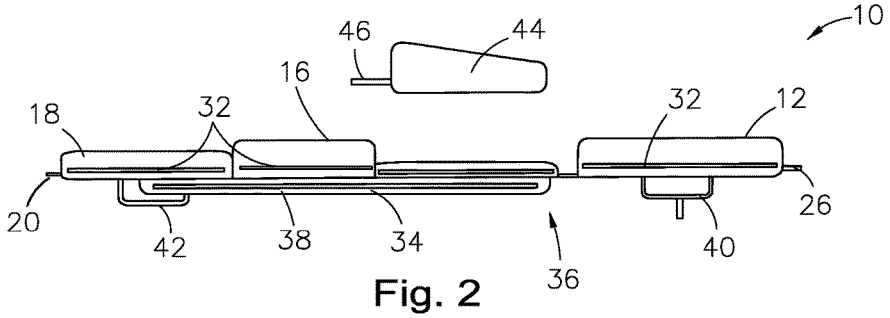
FIG. 2 is a side elevation view of the portable cushion system in accordance with one embodiment.
Figure 3:
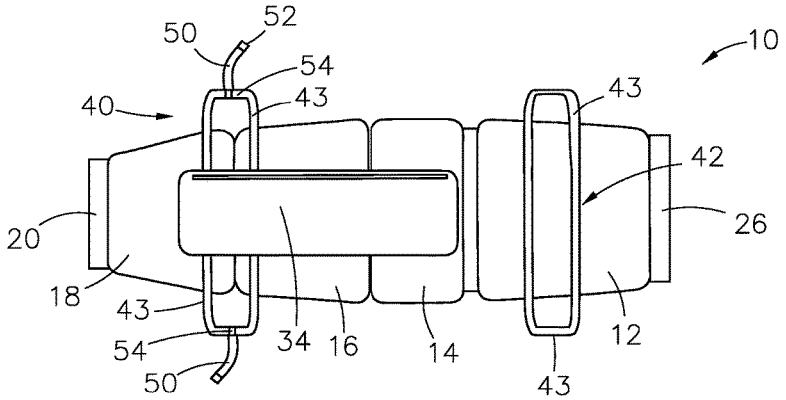
FIG. 3 is a bottom plan view of the portable cushion system in accordance with one embodiment.

Note that FIG. 2 shows that sections 12, 16 and 18 are higher, or are thicker than, than section 14. This arrangement conforms to the body and allows for the user to bend his legs and prop up the torso while lying on the system. This feature make the system more ergonomic and comfortable.

Figure 11:
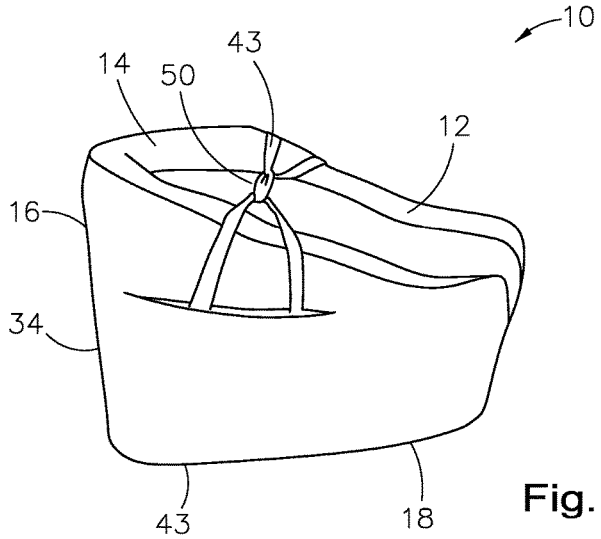
FIG. 11 is a perspective view of the portable cushion system in accordance with one embodiment.
Figure 12:
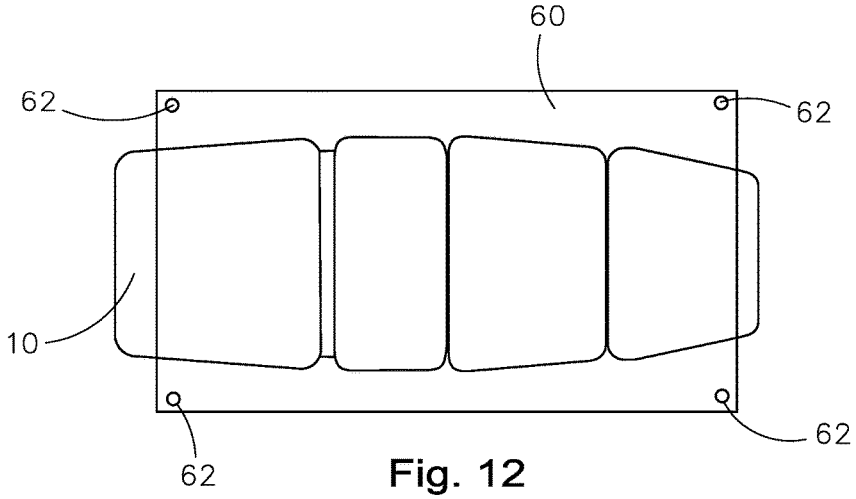
FIG. 12 is a top plan view of the portable cushion system in accordance with one embodiment.

FIGS. 4-5 shows that the ancillary cushion section 44 is configured for placement either on top of the superior cushion section, on top of the midsection cushion section, or under the superior cushion section, via a hingeable coupling. When the ancillary cushion section is placed either on top of the superior cushion section, or under the superior cushion section, the hingeable coupling comprises a hook and loop set including a first part of the hook and loop set on the ancillary cushion section and a second part of the hook and loop set on the superior cushion section. When the ancillary cushion section is placed on top of the midsection cushion section, the hingeable coupling comprises a hook and loop set including a first part of the hook and loop set on the ancillary cushion section and a second part of the hook and loop set on a panel between the midsection cushion section and the superior cushion section. Note that the hingeable coupling between the sections 12, 14, 16 and 18 allows for the system to be placed in different positions. The system be arranged in different arrangements, such as sitting upright, lying flat, and all variations in between. This allows for greater flexibility for the device and allows the user to conform the FIG. 11 shows the chair 10 in a folded configuration. The distal superior fastening strap 26 is removably affixed to the distal inferior fastening strap 20. The laces 50 are looped around their corresponding U-shaped loops 43 on strap 42. The system 10 may then be easily carried by hand similar to a bag or purse.

During use, the chair is folded and carried like a bag, a purse, or over the shoulder. When one reaches the destination they would like to use the item (beach, lawn, etc.), they simply unfold the chair, place it on the ground, remove the items from the pocket including but not limited to a towel, stakes, etc. A beach towel 60 may be placed over the system 10, substantially covering it. The towel 60 includes four through-holes 62 that may be reinforced with grommets. Stakes may be placed through the holes 62 in the towel and into the sand on all four corners. If the user would like to leave the designated area, the user may simply un-stake the area of the towel, and put the items in a storage compartment. When ready to leave, the user may simply un-stake the towel from ground, fold, place in the unit with other belongings, fold unit, and carry on the shoulder with the arm strap.

Figure 13:
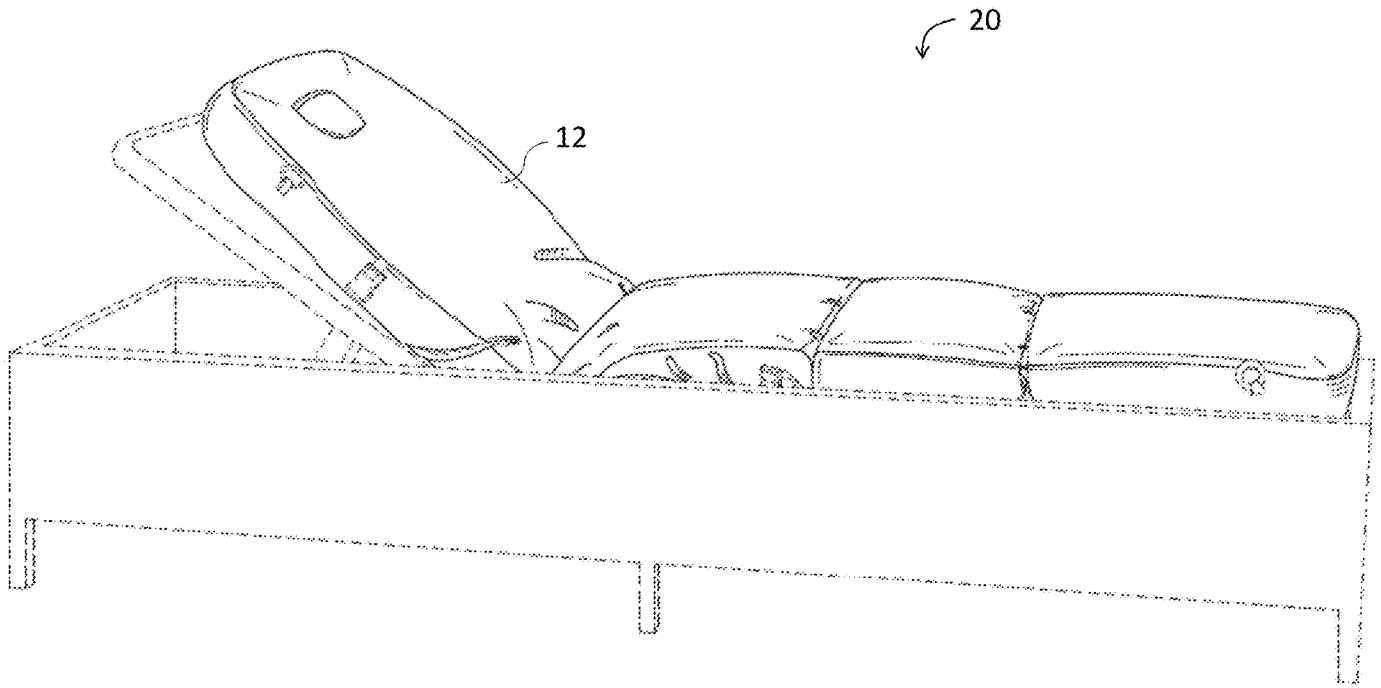
FIG. 13 is a perspective right-side view of a portable cushion system with a back rest portion in an angularly tilted configuration, in accordance with one embodiment.

FIG. 13 is a perspective right-side view of a portable cushion system 20 with a back rest portion in an angularly tilted configuration, in accordance with one embodiment. FIG. 13 shows that the superior cushion section 12 is angled upwards to accommodate a user that is in a semi-upright position, as beach-goers are often seen in a chaise lounge.

Figure 14:
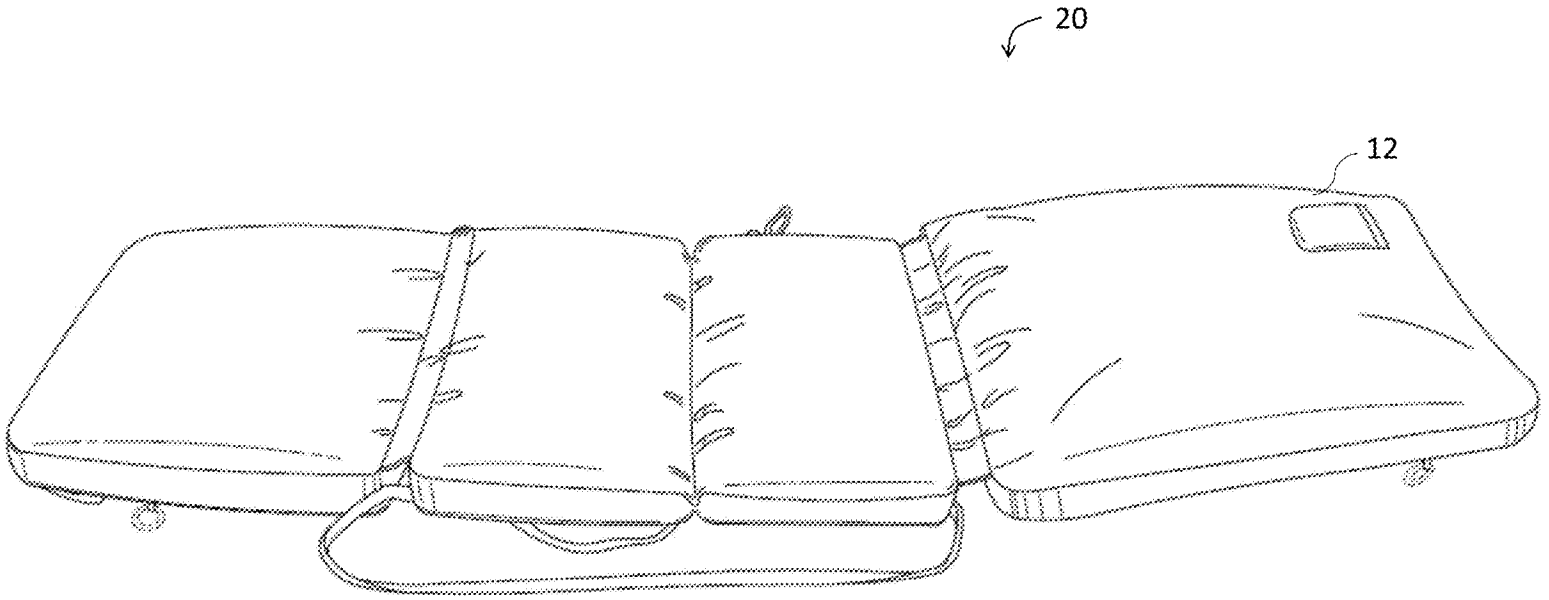
FIG. 14 is a perspective left-side view of the portable cushion system in a substantially flat configuration in accordance with one embodiment.

FIG. 14 is a perspective left-side view of the portable cushion system 20 in a substantially flat configuration in accordance with one embodiment. FIG. 14 shows that the superior cushion section 12 is flat to accommodate a user that is in a lying down position.

Figure 15:
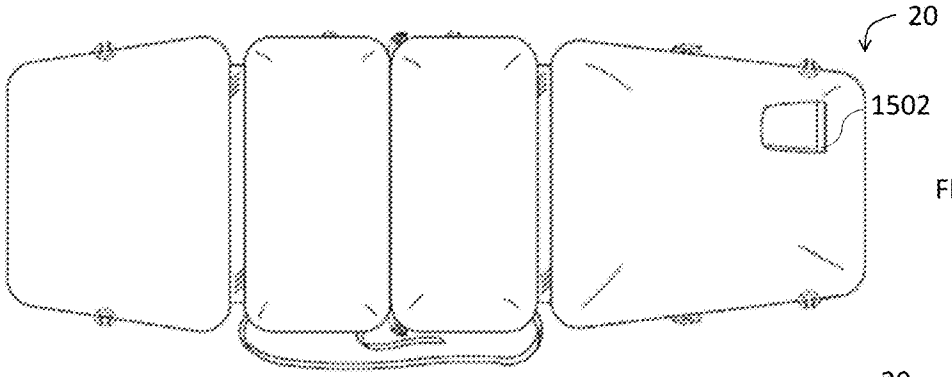
FIG. 15 is a top plan view of the portable cushion system in a substantially flat configuration in accordance with one embodiment.

FIG. 15 is a top plan view of the portable cushion system 20 in a substantially flat configuration in accordance with one embodiment. FIG. 15 shows that the system 20 includes a small pocket 1502 on the front face of the superior cushion section 12.

Figure 16:
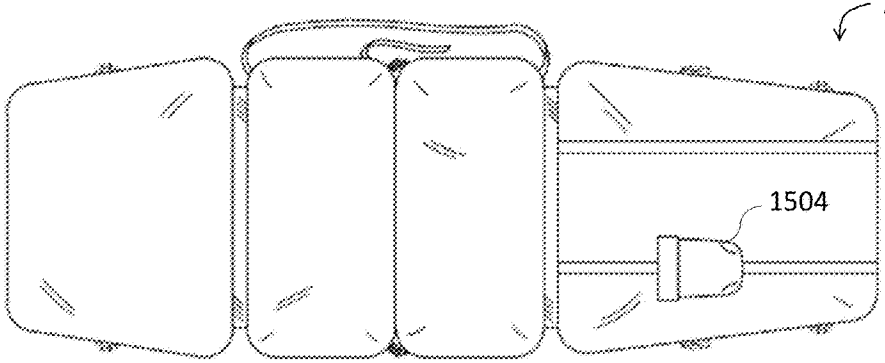
FIG. 16 is a bottom plan view of the portable cushion system in a substantially flat configuration in accordance with one embodiment.

FIG. 16 is a bottom plan view of the portable cushion system 20 in a substantially flat configuration in accordance with one embodiment. FIG. 16 shows that the system 20 includes a small pocket 1504 on the rear or bottom face of the superior cushion section 12.

Figure 17:
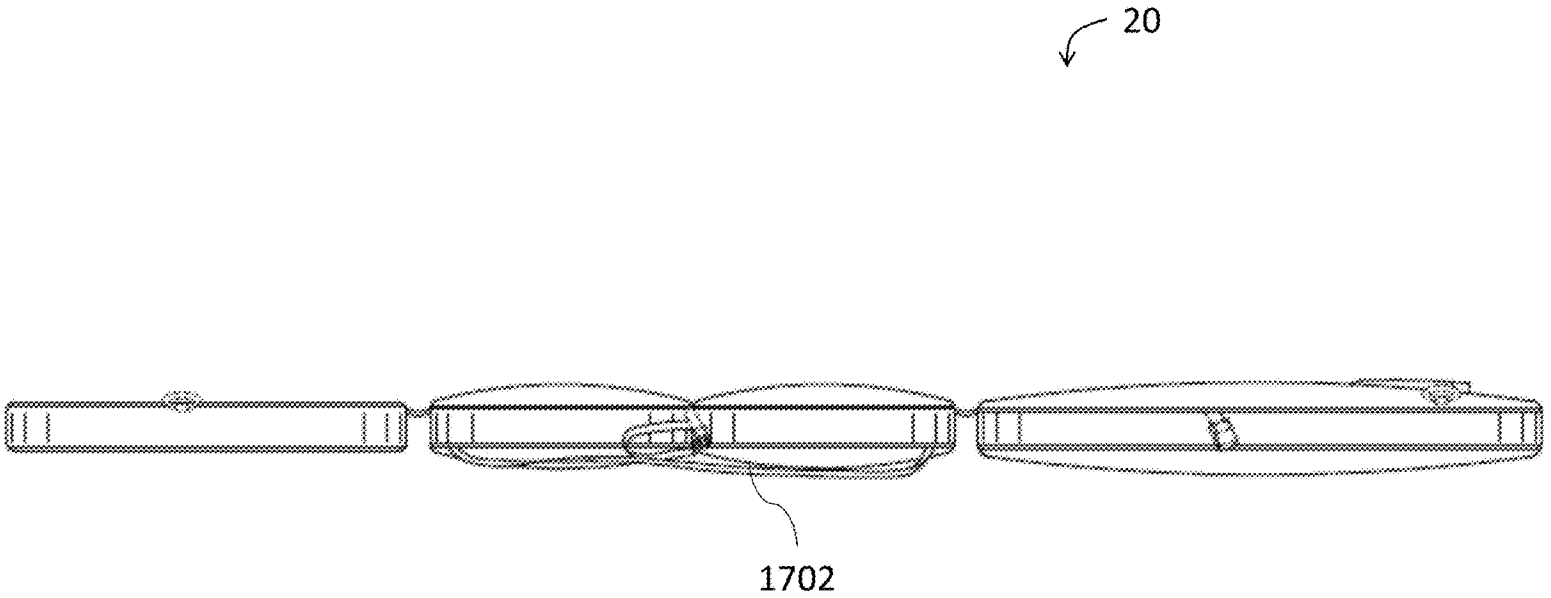
FIG. 17 is an elevational left-side view of the portable cushion system in a substantially flat configuration in accordance with one embodiment.

FIG. 17 is an elevational left-side view of the portable cushion system in a substantially flat configuration in accordance with one embodiment. FIG. 17 shows two straps 1702 that are attached to one end of the midsection cushion section 14 and attached on the other end to the proximal inferior cushion section 16. When the superior, midsection, proximal inferior, and distal inferior cushion sections are folded along the hingeable couplings, the straps are configured for use as shoulder straps for securing and transporting the system.

Figure 18:
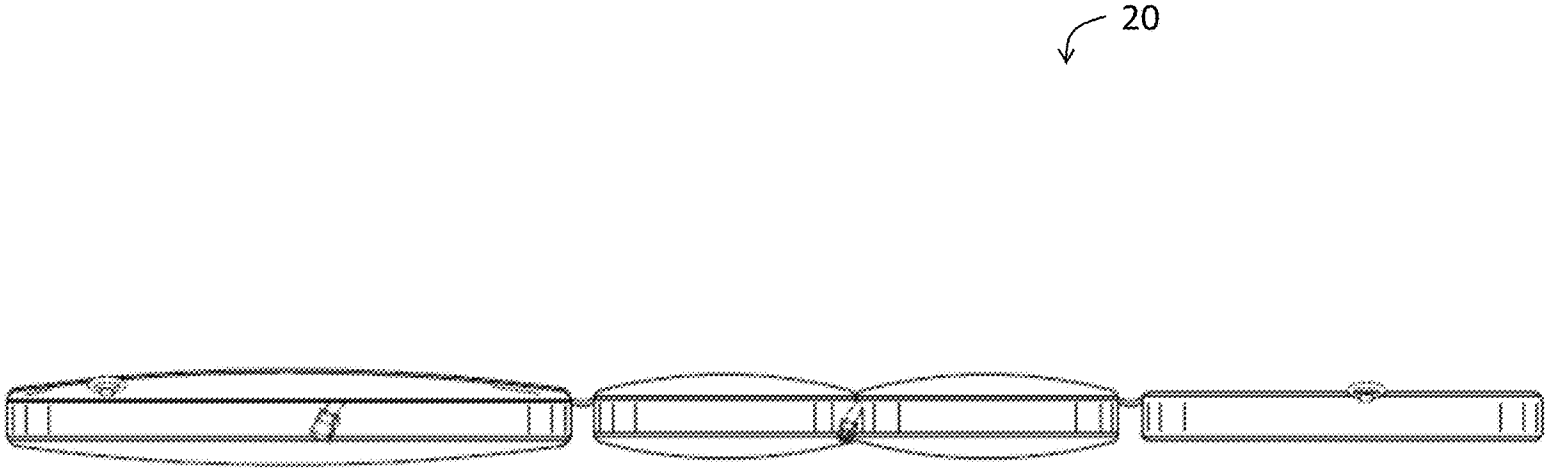
FIG. 18 is an elevational right-side view of the portable cushion system in a substantially flat configuration in accordance with one embodiment.
Figure 20:
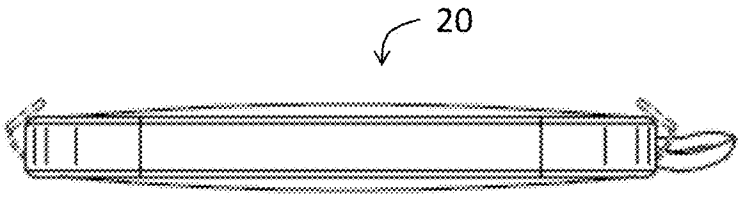
FIG. 20 is an elevational rear end view of the portable cushion system in a substantially flat configuration, from the leg rest portion toward the back rest portion, in accordance with one embodiment.
Figure 19:
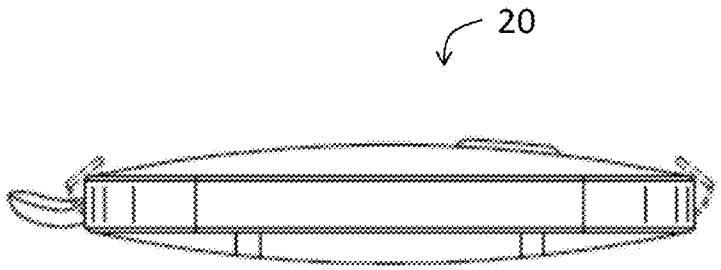
FIG. 19 is an elevational front end view of the portable cushion system in a substantially flat configuration, from the back rest portion toward a leg rest portion, in accordance with one embodiment.

FIG. 18 is an elevational right-side view of the portable cushion system 20 in a substantially flat configuration in accordance with one embodiment. FIG. 19 is an elevational front end view of the portable cushion system 20 in a substantially flat configuration, from the back rest portion toward a leg rest portion, in accordance with one embodiment. FIG. 20 is an elevational rear end view of the portable cushion system 20 in a substantially flat configuration, from the leg rest portion toward the back rest portion, in accordance with one embodiment.

Figure 21:
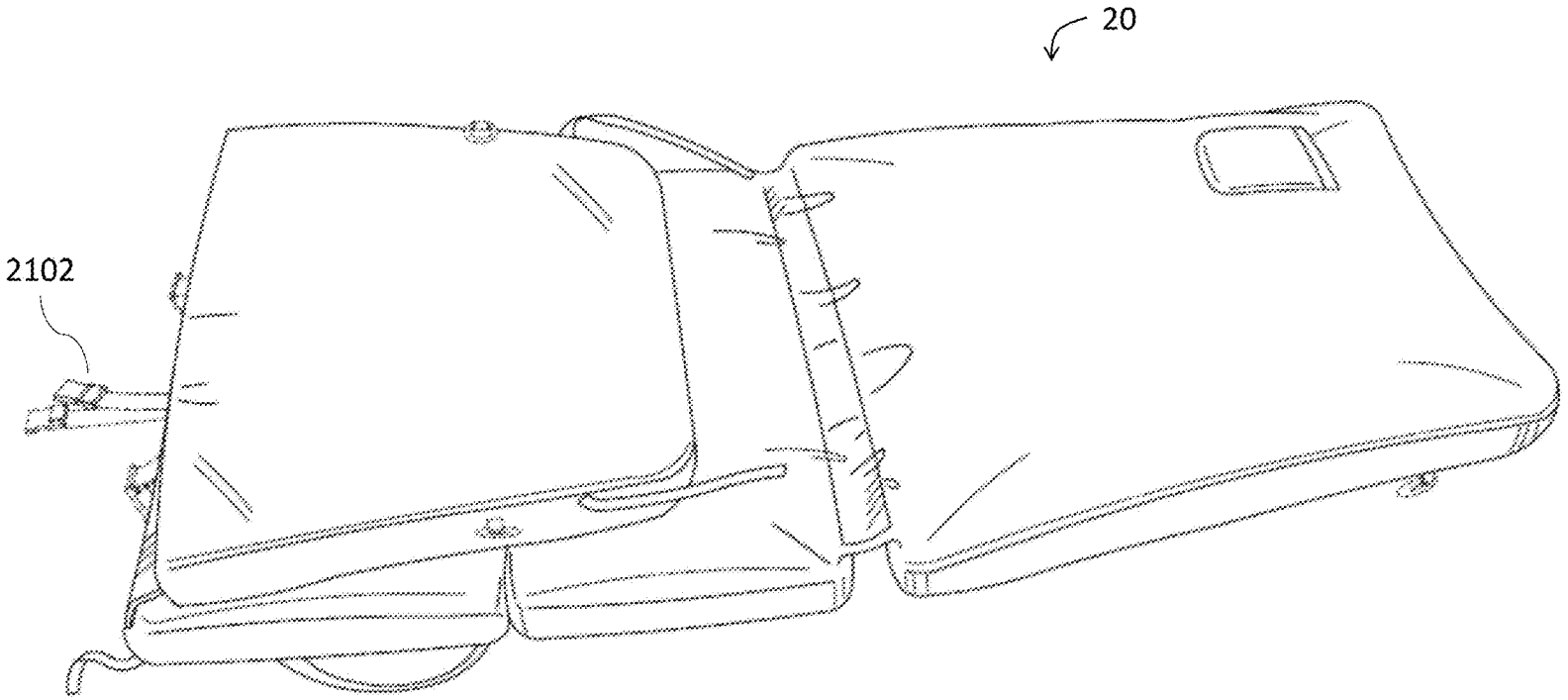
FIG. 21 is a perspective left-side view of the portable cushion system with the leg rest portion folded in accordance with one embodiment.

FIG. 21 is a perspective left-side view of the portable cushion system 20 with the leg rest portion (or distal interior cushion section 18) folded in accordance with one embodiment. FIG. 21 shows two fastener terminal located on the distal inferior cushion section (or between the distal inferior and proximal inferior cushion sections), each fastener terminal configured for fastening to a fastener. Each fastener terminal may comprise a female side release buckle. In one embodiment, the system includes a first strap coupled on one end to the superior cushion section, the first strap including a first fastener on another end, and a second strap coupled on one end to the superior cushion section, the second strap including a second fastener on another end. Each fastener terminal is configured for fastening to a fastener of one of the straps. Wherein when the superior, midsection, proximal inferior, and distal inferior cushion sections are folded along the hingeable couplings, the first fastener is fastened to a fastener terminal, the second fastener is fastened to a fastener terminal, and the first and second straps are configured for use as shoulder straps for securing and transporting the system. The first and second fasteners may comprise a male side release buckle.

Figure 22:
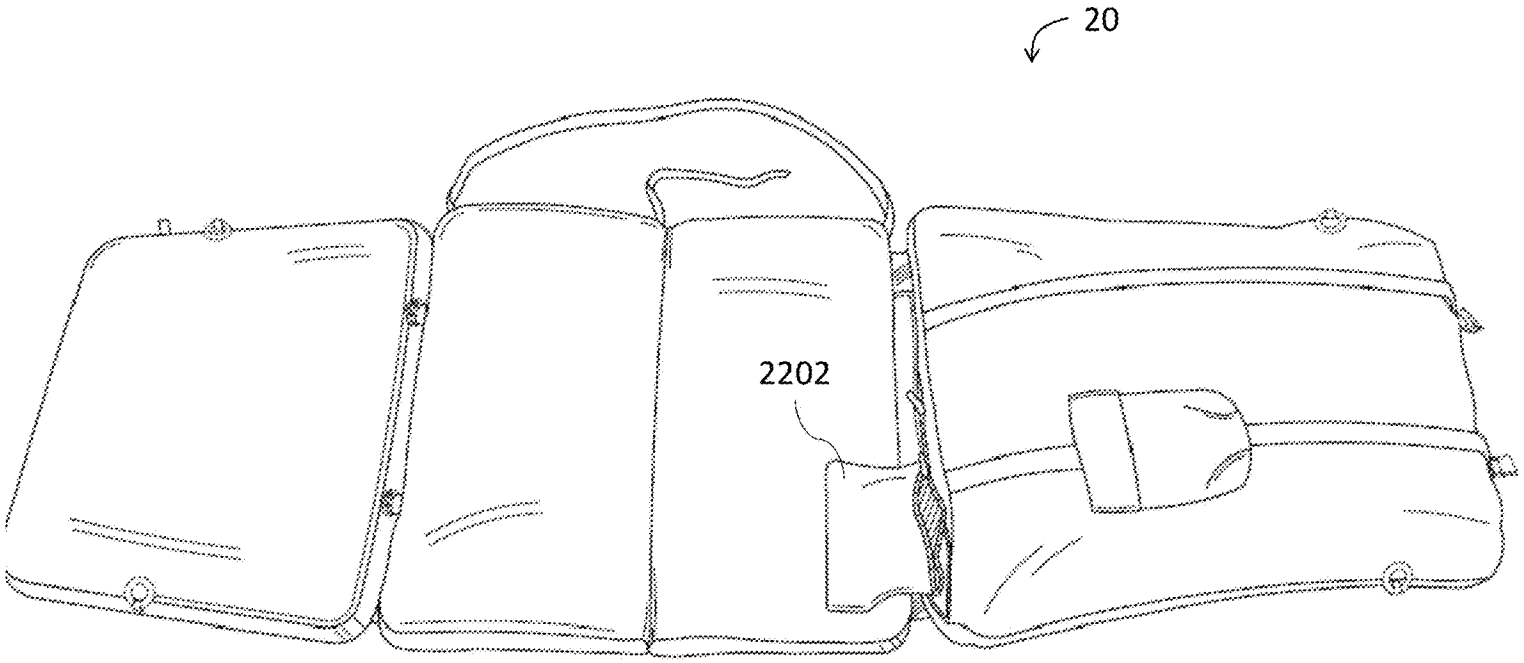
FIG. 22 is a perspective bottom-side view of the portable cushion system in a substantially flat configuration, with an interior pocket pulled and exposed outward from the portable cushion system, in accordance with one embodiment.

FIG. 22 is a perspective bottom-side view of the portable cushion system 20 in a substantially flat configuration, with an interior pocket 2202 pulled and exposed outward from the portable cushion system, in accordance with one embodiment. The interior pocket 2202 may be coupled to the panel 30 between the superior and midsection cushion sections. The interior pocket may also be configured to be stuffed inside of a larger pocket for hiding.

Figure 23:
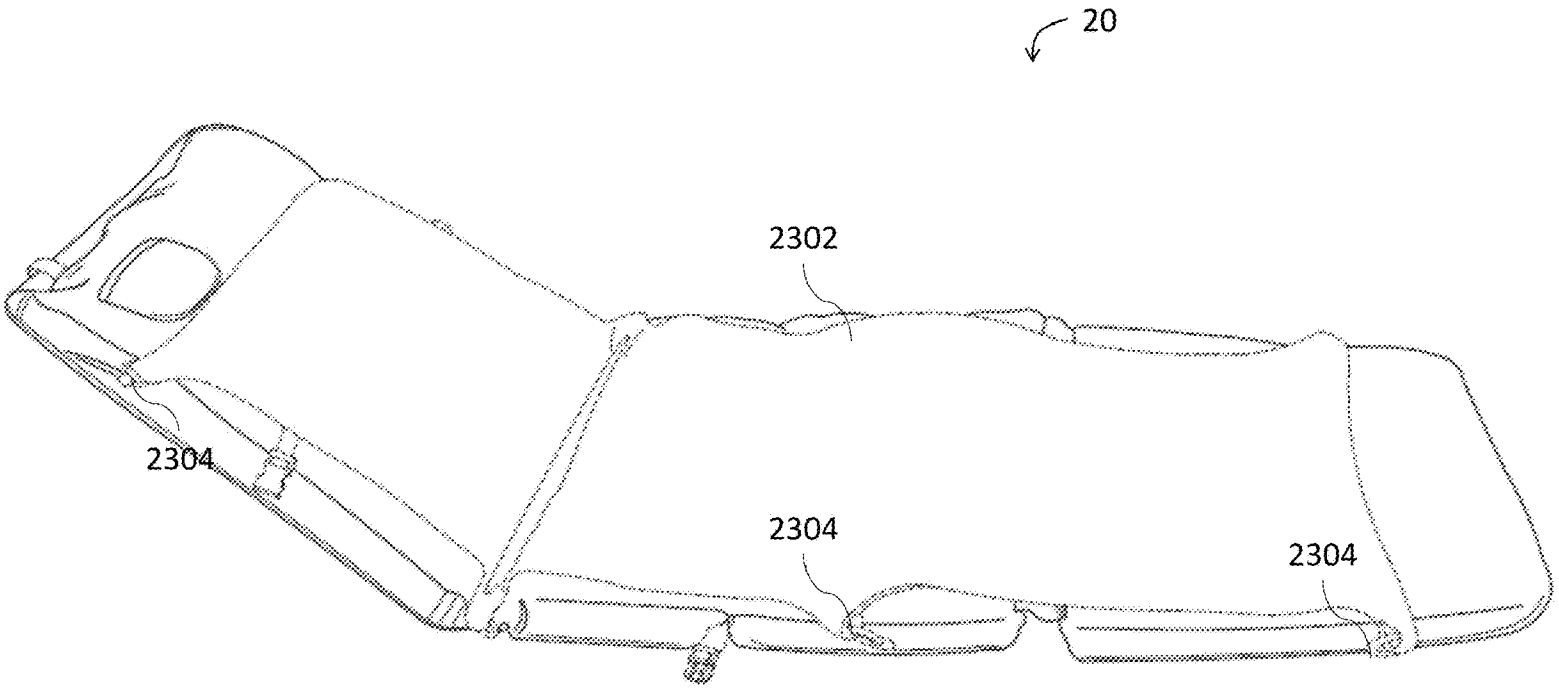
FIG. 23 is a perspective right-side view of the portable cushion system with the back rest portion in an angularly tilted configuration, and with a connected towel, in accordance with one embodiment.

FIG. 23 is a perspective right-side view of the portable cushion system 20 with the back rest portion in an angularly tilted configuration, and with a connected towel 2302, in accordance with one embodiment. FIG. 23 also shows one or more rings 2304 coupled to the superior cushion section, the proximal inferior cushion section and the distal inferior cushion section, wherein said one or more rings are configured for coupling to the towel 2302 that is placed on top of the system.

Figure 24:
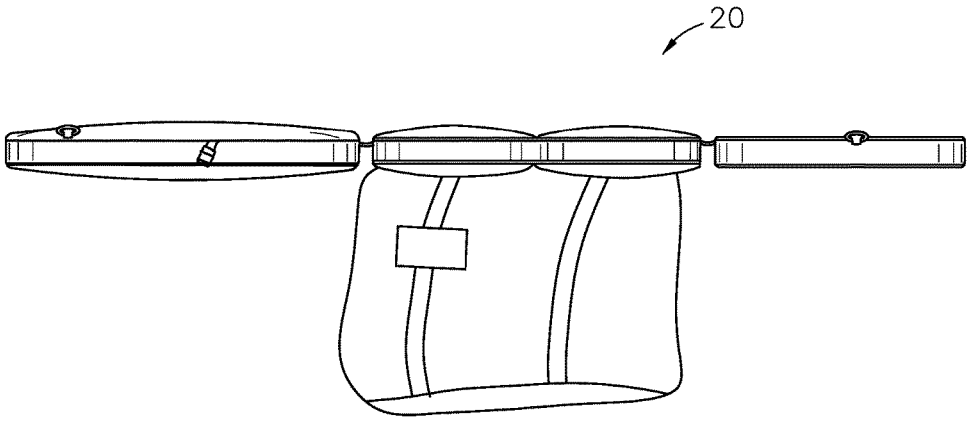
FIG. 24 is an elevational right-side view of the portable cushion system in a substantially flat configuration, and used with a storage bag, in accordance with one embodiment.

FIG. 24 is an elevational right-side view of the portable cushion system in a substantially flat configuration, and used with a storage bag, in accordance with one embodiment. FIG. 24 shows that a bag, such as a space-saving vacuum seal storage bag.

Figure 25:
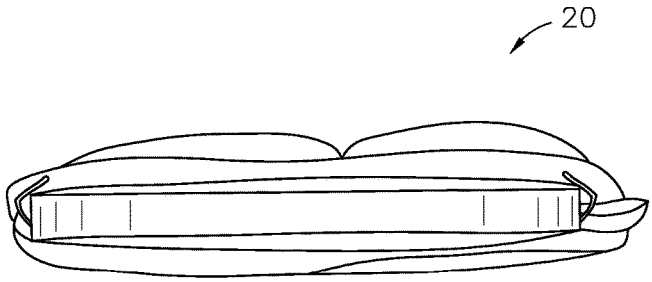
FIG. 25 is an elevational rear end view of the portable cushion system in a substantially flat configuration, from the leg rest portion toward the back rest portion, and used with a storage bag, in accordance with one embodiment.

FIG. 25 is an elevational rear end view of the portable cushion system in a substantially flat configuration, from the leg rest portion toward the back rest portion, and used with a storage bag, in accordance with one embodiment. FIG. 25 shows that the entire system 20 may fit inside of a space-saving vacuum seal storage bag, thereby saving space during storage.

Figure 26:
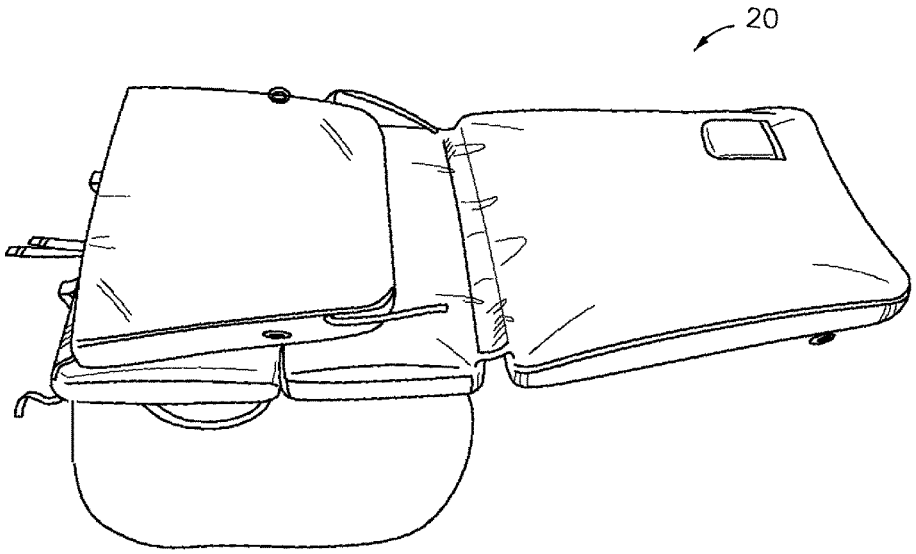
FIG. 26 is a perspective left-side view of the portable cushion system with the leg rest portion folded, and used with a storage bag, in accordance with one embodiment.

FIG. 26 is a perspective left-side view of the portable cushion system with the leg rest portion folded, and used with a storage bag, in accordance with one embodiment. FIG. 26 shows that the space-saving vacuum seal storage bag may be located behind the midsection cushion section when not in use.

It should be noted that the superior, midsection, proximal inferior, and distal inferior cushion sections may each comprise a cover that is filled with cushion material, such as foam padding, polystyrene balls, etc. A cover comprises a fabric enclosure including a zipper that provides access to an interior volume of the cover. It should be noted that each cushion section may be coupled to another cushion section using a hingeable coupling, wherein a hingeable coupling may comprise a seam between a first piece of fabric and a second piece of fabric, such that the first and second pieces of fabric may rotate about the seam. The hingeable coupling may also comprise a hook and loop set between a first piece of fabric and a second piece of fabric, such that the first and second pieces of fabric may rotate about the hook and loop set.

Figure 27:
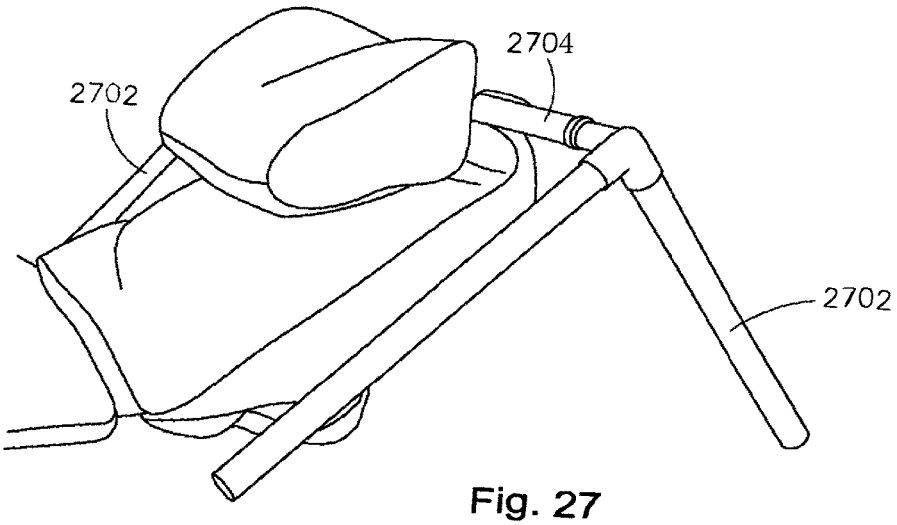
FIG. 27 is a perspective side view of the portable cushion system used with a back stand, in accordance with one embodiment.

FIG. 27 is a perspective side view of the portable cushion system used with a back stand, in accordance with one embodiment. FIG. 27 shows that a back stand is located behind the system 20. The back stand comprises two V-shaped elements 2702 connected at their apex by a single shaft 2704. When placed on the ground, this back stand elevates the single shaft. Then, the distal end of the superior section cushion may be attached to the single shaft, so as to prop up the superior section cushion. This arrangement provides a system whereby the superior section cushion may be securely raised from the ground, such that the user is in a semi-upright position, as opposed to lying flat on the ground. The superior section cushion may be coupled to the back stand using one or more straps, hook and loop straps or buckles. Also, each of the V-shaped elements may include a hinge at the apex, so as to allow the legs of the V-shaped element to collapse, to allow for easier storage and transport. Alternatively, each of the V-shaped elements may include a ball bearing at the apex, so as to allow the legs of the V-shaped element to collapse, to allow for easier storage and transport.

Also, the legs of the V-shaped elements may be telescopic legs that allow for adjustment of the length of the legs, so as to allow for different heights at which to raise the superior section cushion from the ground. An expandable frame for the back stand collapses into itself and has a locking mechanism which locks the legs into place. The purpose of this feature is to make the back stand taller or shorter depending on desired sitting position. A ball bearing may be attached to the top of the back stand which will allow the structure to collapse into itself or swivel depending on desired position.

In one embodiment, any of the components of the system described above may comprise any type of fabric, including woven and unwoven fabrics, natural fabrics, synthetic fabrics, weather resistant fabrics, and any combination of the foregoing. Also, any of the hardware components of the system described above, such as fasteners, may comprise plastic, polyethylene, PVC, aluminum, steel, tin, copper, brass, iron, bronze, nickel, zinc, and all metal alloys.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A portable cushion system for a user, the system comprising:

(a) a superior cushion section comprising a cushion apparatus with a cover, wherein the superior cushion section is configured for placement under the user's head and upper torso;

(b) a midsection cushion section coupled to the superior cushion section via a hingeable coupling, the midsection cushion section comprising a cushion apparatus with a cover, wherein the midsection cushion section is configured for placement under the user's seat and lower back;

(c) a proximal inferior cushion section coupled to the midsection cushion section via a hingeable coupling, the proximal inferior cushion section comprising a cushion apparatus with a cover, wherein the proximal inferior cushion section is configured for placement under the user's upper legs;

(d) a distal inferior cushion section coupled to the proximal inferior cushion section via a hingeable coupling, the distal inferior cushion section comprising a cushion apparatus with a cover, wherein the distal inferior cushion section is configured for placement under the user's lower legs;

(e) a first strap coupled on one end to the superior cushion section, the first strap including a first fastener on another end;

(f) a second strap coupled on one end to the superior cushion section, the second strap including a second fastener on another end;

(g) a first fastener terminal located on the distal inferior cushion section, the first fastener terminal configured for fastening to the first fastener of the first strap;

(h) a second fastener terminal located on the distal inferior cushion section, the second fastener terminal configured for fastening to the second fastener of the second strap;

(i) a panel of fabric located between the superior cushion section, and the midsection cushion section;

(j) a pocket coupled to and extending from the panel of fabric, said pocket formed spatially separate from the superior cushion section and the midsection cushion section; and (k) wherein when the superior, midsection, proximal inferior, and distal inferior cushion sections are folded along said hingeable couplings, the first fastener is fastened to the first fastener terminal, the second fastener is fastened to the second fastener terminal, and the first and second straps are configured for use as shoulder straps for securing and transporting the system.

2. The portable cushion system of claim 1, wherein when the superior, midsection, proximal inferior, and distal inferior cushion sections each comprise a cover that is filled with cushion material.

3. The portable cushion system of claim 1, wherein the first fastener terminal and the second fastener terminal each comprise a female side release buckle.

4. The portable cushion system of claim 1, further comprising one or more rings coupled to the superior cushion section, the proximal inferior cushion section and the distal inferior cushion section, wherein said one or more rings are configured for coupling to a towel that is placed on top of the system.

5. The portable cushion system of claim 4, further comprising a small pocket located on top of, and coupled to, the superior cushion section.

6. The portable cushion system of claim 1, further comprising a stand located behind, and coupled to, a distal portion of the superior cushion section, so as to raise the superior cushion section from the ground.

7. A portable cushion system for a user, the system comprising:

(a) a superior cushion section comprising a cushion apparatus with a cover, wherein the superior cushion section is configured for placement under the user's head and upper torso;

(b) a midsection cushion section coupled to the superior cushion section via a hingeable coupling, the midsection cushion section comprising a cushion apparatus with a cover, wherein the midsection cushion section is configured for placement under the user's seat and lower back;

(c) a proximal inferior cushion section coupled to the midsection cushion section via a hingeable coupling, the proximal inferior cushion section comprising a cushion apparatus with a cover, wherein the proximal inferior cushion section is configured for placement under the user's upper legs;

(d) a distal inferior cushion section coupled to the proximal inferior cushion section via a hingeable coupling, the distal inferior cushion section comprising a cushion apparatus with a cover, wherein the distal inferior cushion section is configured for placement under the user's lower legs;

(e) an ancillary cushion section configured for coupling to the superior cushion section via a hingeable coupling;

(f) a first strap coupled on one end to the superior cushion section, the first strap including a first fastener on another end;

(g) a second strap coupled on one end to the superior cushion section, the second strap including a second fastener on another end;

(h) a first fastener terminal located on the distal inferior cushion section, the first fastener terminal configured for fastening to the first fastener of the first strap;

(i) a second fastener terminal located on the distal inferior cushion section, the second fastener terminal configured for fastening to the second fastener of the second strap;

(j) a panel of fabric located between the superior cushion section, and the midsection cushion section;

(k) a pocket coupled to and extending from the panel of fabric, said pocket formed spatially separate from the superior cushion section and the midsection cushion section; and (l) wherein when the superior, midsection, proximal inferior, and distal inferior cushion sections are folded along said hingeable couplings, the first fastener is fastened to the first fastener terminal, the second fastener is fastened to the second fastener terminal, and the first and second straps are configured for use as shoulder straps for securing and transporting the system.

* * * * *